US006886869B2

(12) United States Patent
Martinez et al.

(10) Patent No.: US 6,886,869 B2
(45) Date of Patent: May 3, 2005

(54) ELECTROMECHANICAL LOCKING MECHANISM

(76) Inventors: Richard A. Martinez, 936 Forest, River Forest, IL (US) 60305; Brian Lee Hahn, 422 Lamont Ter., Buffalo Grove, IL (US) 60089; Mitch Mlynarczyk, 3840 N. Firestone Dr., Hoffman Estates, IL (US) 60195; Michael Koch, 190 Norfolk Ct. #3, Roselle, IL (US) 60172; Robert Brewczynski, 404 Haber Ct., Northlake, IL (US) 60164; Claudia Juliana Bevilacqua, 2635 Atlantic St., Franklin Park, IL (US) 60131; Kenneth A. Kaczmarz, 1225 Morgan Ave., LaGrange Park, IL (US) 60526; Brock Robinson, 1910 Cowing La., Crest Hill, IL (US) 60435; John Payson, 1481 Fairway Dr., Apt. 303, Naperville, IL (US) 60563

( * ) Notice: Subject to any disclaimer, the term of this patent is extended or adjusted under 35 U.S.C. 154(b) by 0 days.

(21) Appl. No.: 10/318,328

(22) Filed: Dec. 12, 2002

(65) Prior Publication Data

US 2003/0127866 A1 Jul. 10, 2003

Related U.S. Application Data

(60) Provisional application No. 60/341,407, filed on Dec. 14, 2001.

(51) Int. Cl.[7] ..... E05C 3/06

(52) U.S. Cl. ..... 292/216; 292/96; 292/98; 292/129; 292/201; 292/DIG. 43; 292/DIG. 69

(58) Field of Search ..... 292/95, 96, 216, 292/201, DIG. 43, DIG. 69, 98, 129; 49/280

(56) References Cited

U.S. PATENT DOCUMENTS

| | | | | | |
|---|---|---|---|---|---|
| 3,942,828 | A | * | 3/1976 | Bourrie et al. | 292/201 |
| 4,258,945 | A | * | 3/1981 | Pouget | 292/68 |
| 4,268,076 | A | * | 5/1981 | Itoi | 292/216 |
| 4,613,176 | A | * | 9/1986 | Kelly | 292/201 |
| 4,667,990 | A | * | 5/1987 | Quantz | 292/201 |
| 4,796,932 | A | * | 1/1989 | Tame | 292/112 |
| 4,978,153 | A | * | 12/1990 | Hirsch et al. | 292/201 |
| 5,007,261 | A | * | 4/1991 | Quantz | 70/240 |
| 5,148,691 | A | * | 9/1992 | Wallden | 70/279.1 |
| 5,575,515 | A | * | 11/1996 | Iwamoto et al. | 292/341.17 |
| 5,639,130 | A | * | 6/1997 | Rogers et al. | 292/216 |
| 6,036,241 | A | * | 3/2000 | Ostdiek et al. | 292/229 |
| 6,068,305 | A | * | 5/2000 | Myers et al. | 292/201 |
| 6,076,868 | A | * | 6/2000 | Roger et al. | 292/201 |
| 6,152,498 | A | * | 11/2000 | Lindqvist | 292/53 |
| 6,216,980 | B1 | * | 4/2001 | Baudu et al. | 244/110 B |
| 6,485,071 | B2 | * | 11/2002 | Schwaiger | 292/216 |
| 6,684,671 | B2 | * | 2/2004 | Beylotte et al. | 70/208 |
| 2002/0060457 | A1 | * | 5/2002 | Roatis et al. | 292/199 |

OTHER PUBLICATIONS http://www.triteqlock.com TriTeq Lock and Security, Mar. 19, 2003 (visited).

http://www.videx.com CyberLock Locking in on Your Security, Mar. 19, 2003 (visited).

http://www.medeco.com/products/products.php, Medeco-Products, Mar. 19, 2003 (visited).

* cited by examiner

*Primary Examiner*—Daniel P. Stodola
*Assistant Examiner*—Carlos Lugo
(74) *Attorney, Agent, or Firm*—Dority & Manning, P.A.

(57) ABSTRACT

A locking mechanism is provided. The locking mechanism includes a mounting plate that carries a locking hook. The locking hook is pivotal with respect to the mounting plate and may be pivoted from an unlocked position to a locked position. A motor is in communication with a locking hook, and is capable of causing the locking hook to be pivoted to the locked position. The locking mechanism may be opened by use of an electronic key, and may contain electronics capable of recording the date and time a particular key was used to open the locking mechanism. Also, the locking mechanism may be capable of being locked without the use of the motor when the motor is disabled due to power disruption or other circumstances.

26 Claims, 10 Drawing Sheets

ELECTROMECHANICAL LOCKING MECHANISM

RELATED APPLICATIONS

The present application claims benefit to provisional U.S. patent application Ser. No. 60/341,407 entitled "Electromechanical Locking Mechanism", filed Dec. 14, 2001. The entire disclosure of this application No. 60/341,407 is incorporated by reference herein in its entirety for all purposes.

BACKGROUND

The present invention is intended as an improvement to pop out handle locks used typically in vending machines and utilized to lockingly engage the door to the main chamber of the machine.

In a typical application, a pop out handle system, the door contains a lock mechanism, which includes a pop out handle, actuated by an appropriate key which is exposed to the outer portion of the door. The interior portion of the lock mechanism includes a threaded stud, which extends toward the main chamber of the machine and is typically adapted to be screw threaded into a stud receiving fixture, securely mounted to the inside portion of the main chamber.

To unlock the pop out handle lock, and operator inserts the proper key into the lock placed inside the pop out handle, which actuates the handle to pop towards the user. The handle is then turned counterclockwise, which unscrews the lock stud from the internal locking fixture.

In order to lock the door to the main chamber, the operator reverses the procedure, such that the door is closed and the stud is oriented in linear alignment with the internal locking fixture (which usually contains a threaded nut), then the handle is rotated clockwise, resulting in engaging the stud into the locking fixture. When the thread is fully engaged, the operator depresses the handle into the recess provided by the machine and the depressed position is maintained by the engagement of a locking bolt.

The current design requires significant effort and time to be spent by the person who is filling the vending machine (routeman) when the door is being opened and closed. There is no record of who entered the machine and when the machine was entered. The machine is easily compromised by anyone who has duplicated a key, which is an easy task. If it has been determined that a key had been stolen, or duplicated, there is significant effort, time and expense involved in re-keying the lock.

SUMMARY OF THE INVENTION

The present invention is a motorized lock, mounted to the inside of a vending machine door or the cabinet. It is intended to decrease the amount of time required to lock the machine by providing a motorized draw-in feature which will pull the door tight and lock it. This draw-in feature is completely automatic. Further, the present invention allows for quick entry of the vending machine, which is actuated by the routeman showing an electronic key. The control electronics for the lock are capable of a large number of different keys being used to gain entry to the vending machine, and will remember an "audit trail". The "audit trail" consists of the key that gained access, the date and the time of access. A significant history can be developed, limited only by the size of the memory chips in the controller.

According to the present invention, a gear motor is attached to a slotted link, which pulls a locking hook which hooks a u-bolt, or a headed bolt, which closes the vending machine door. The gear motor is under the control of a microprocessor based circuit which employs three switches for feedback.

The operation of the lock is as follows. For purposes of this description, the starting point will be with the locking hook and the door open with the routeman filling the machine. To begin the close cycle, the routeman swings the door such that it is in close proximity to the main chamber of the machine. This action closes a feedback switch, S3, which sends a signal to the control circuit which turns the motor on. S3 is a plunger type switch, located in the main chamber of the machine such that the door plunges the switch when the door closes. The motor is connected to a multifunction cam wheel which, in turn, is connected to a slotted link, which, in turn, is connected to the spring loaded locking hook. The starting of the motor begins to rotate the locking hook. The locking hook "hooks" a u-bolt, or headed bolt, which is attached to the main chamber of the vending machine. The locking hook is shaped such that it draws the u-bolt in as it rotates, bringing the door closer to the main chamber. The locking hook is provided with six teeth which are engaged by a ratchet mechanism as the hook rotates. This continues until the door gasket between the door and the main chamber is compressed, and two additional feedback switches, S1 and S2 close. These switches close due to actuation by two cam surfaces on the multi function wheel. In this condition, the machine is completely sealed and locked. The ratchet mechanism is seated behind the last locking hook tooth, which is held solidly in place by a loaded extension spring between the locking hook and the main housing.

When the routeman wants to gain access to the inside of the machine, an electronic key is needed. Each electronic key is provided with a unique electronic serial number and a unique password. Each password is unique to each machine, so a plurality of passwords are stored in each key. The routeman places the electronic key on the key reader and it is read by the control circuit. The control circuit then decodes the key number, which is encrypted, and checks it against its internal database. If the key number is in the data base, the control circuit then electronically reads the password assigned to that machine. If the passwords match, the key is deemed valid. The password is then changed for the next access, and the new password is loaded into the key and is remembered in nonvolatile memory in the control circuit.

The motor is then turned on, which rotates the multifunction wheel. One of cams on the wheel engage a ratchet release lever, which pushes the ratchet off of the last tooth of the locking hook, causing the locking hook to pop open, as the loaded locking hook extension spring brings the locking hook open. This causes the vending machine door to open slightly. The wheel continues to rotate until feedback switch S1 opens. In this position, the locking hook is completely free to rotate allowing the routeman to open the vending machine door fully. S3 opens when the door opens and the motor again begins to rotate the multifunction wheel. The cam surface that was engaging the ratchet release lever travels past the lever, which releases the ratchet. Another cam surface on the multifunction wheel then pushes the ratchet down to engage the first tooth of the locking hook. The wheel continues to rotate until feedback switch S2 opens. At this time, the ratchet is engaged into the locking hook, such that if the door was closed, the u-bolt, or headed bolt, would hit the locking hook. The link that connects the multifunction wheel to the locking hook is provided with a slot on the wheel end. This slot allows the locking hook to advance before the motor turns on. If the u-bolt, or headed bolt, hits the locking hook it will cause it to rotate slightly, advancing the ratchet to the second tooth. At that time, the follower attached to the wheel travels down the slot in the link. The harder the door was closed, the further the locking hook would rotate, advancing the ratchet further. This feature is very important, since it allows latching of the door without electricity. When the motor turns on (due to S3 being plunged), the follower, attached to the multifunction wheel, first travels to the end of the slot on the link. The follower then pulls the link, which rotates the locking hook about the locking hook fulcrum to close and seal the door. If power was lost during a vending machine fill operation and the routeman slammed the door shut, the controller would, upon power up, see that S3 was closed and S1 and S2 were both open. This condition would be a vending machine with the door closed and the multifunction wheel in a position where the locking hook was not fully drawn closed. As such, the controller would automatically turn on the motor to advance the wheel until S1 and S2 were closed.

DETAILED DESCRIPTION

Figure 1:
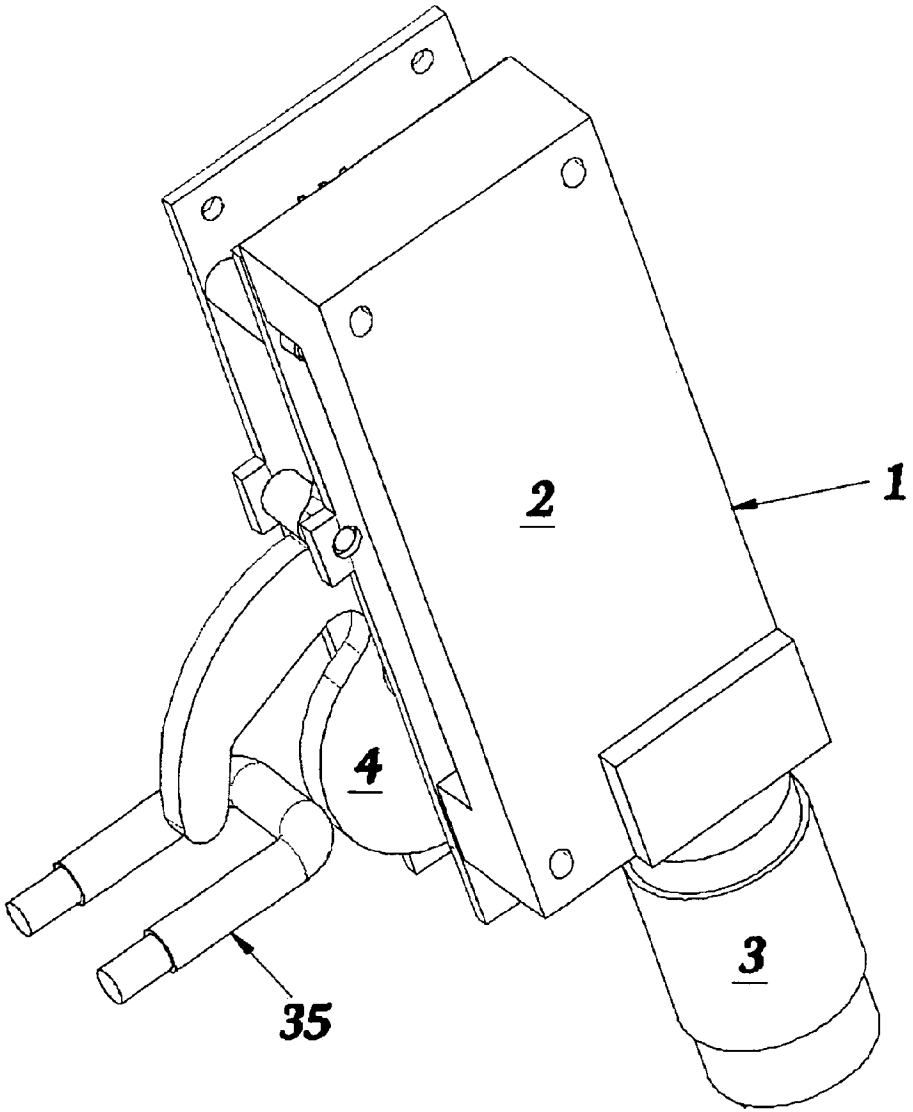
FIG. 1 is an upper right perspective of the present invention.

Turning first to FIG. 1, reference numeral 1 designates the gear motor, which includes a motor 3 and a gear box 2. The gear motor is coupled, through a linkage mechanism, to drive locking hook 4, which engages and pulls in u-bolt 35.

This u-bolt 35 could be substituted for a headed bolt and the locking hook 4 could be substituted for a claw shaped device which would grab the headed bolt around the head and pull it in.

Figure 2:
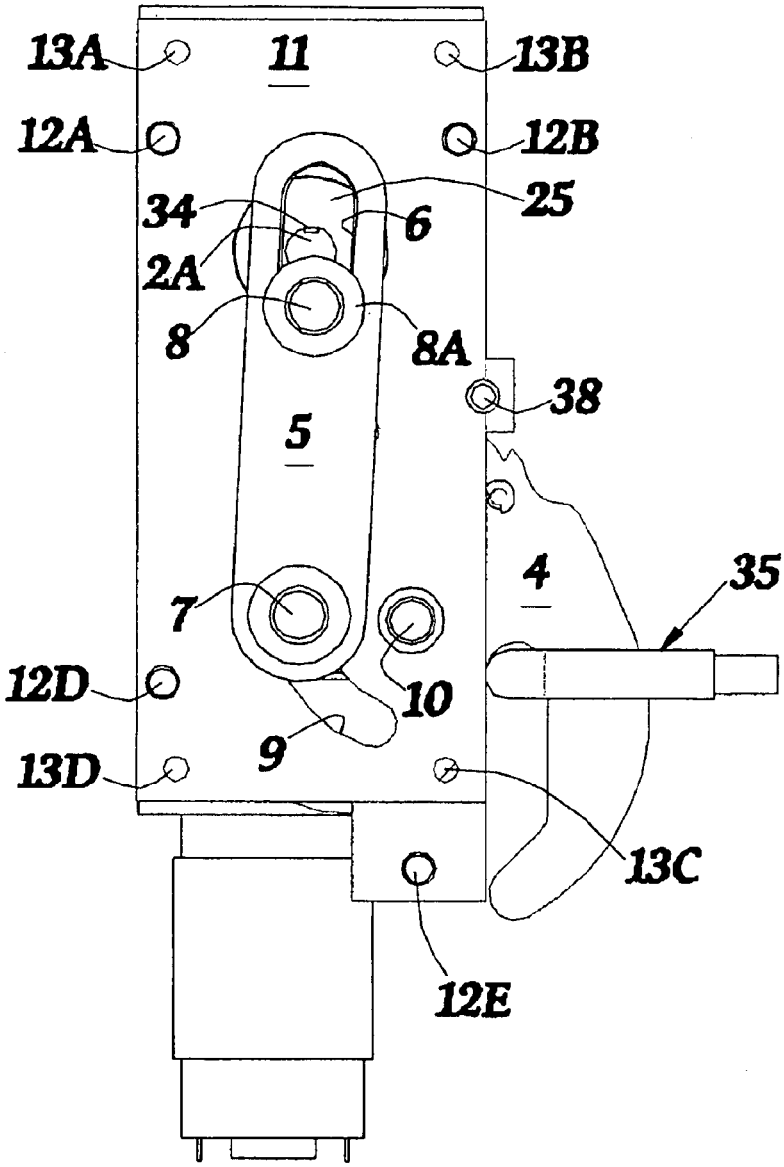
FIG. 2 is the left-side view of the lock of FIG. 1.

Turning now to FIG. 2, the left side view of the lock is illustrated. The output shaft 2*a* of the gearbox 1 is coupled to multifunction wheel 25 with key 34. The multifunction wheel 25 rotates, moving motor pull point 8 in a counterclockwise fashion (in this view). As the motor pull point moves, it pulls link 5 by cam follower 8A sliding up slot 6 which is integral to link 5. When the end of slot 6 is reached, link 5 begins to move in an upwardly fashion, rotating locking hook 4 about locking hook fulcrum 10. The locking hook 4 is pulled at locking hook pull point 7 which travels in slot 9. As the locking hook 4 rotates, it pulls u-bolt (or headed bolt) 35 towards the lock assembly.

The gear motor 1 is attached to mounting plate 11 by motor mount screws 13A,B,C,D. Mounting plate 11 has a corresponding mounting plate (not shown) on the inside of locking hook 4. The two mounting plates 11 are further held together by assembly screws 12A,B,D,E.

Figure 3:
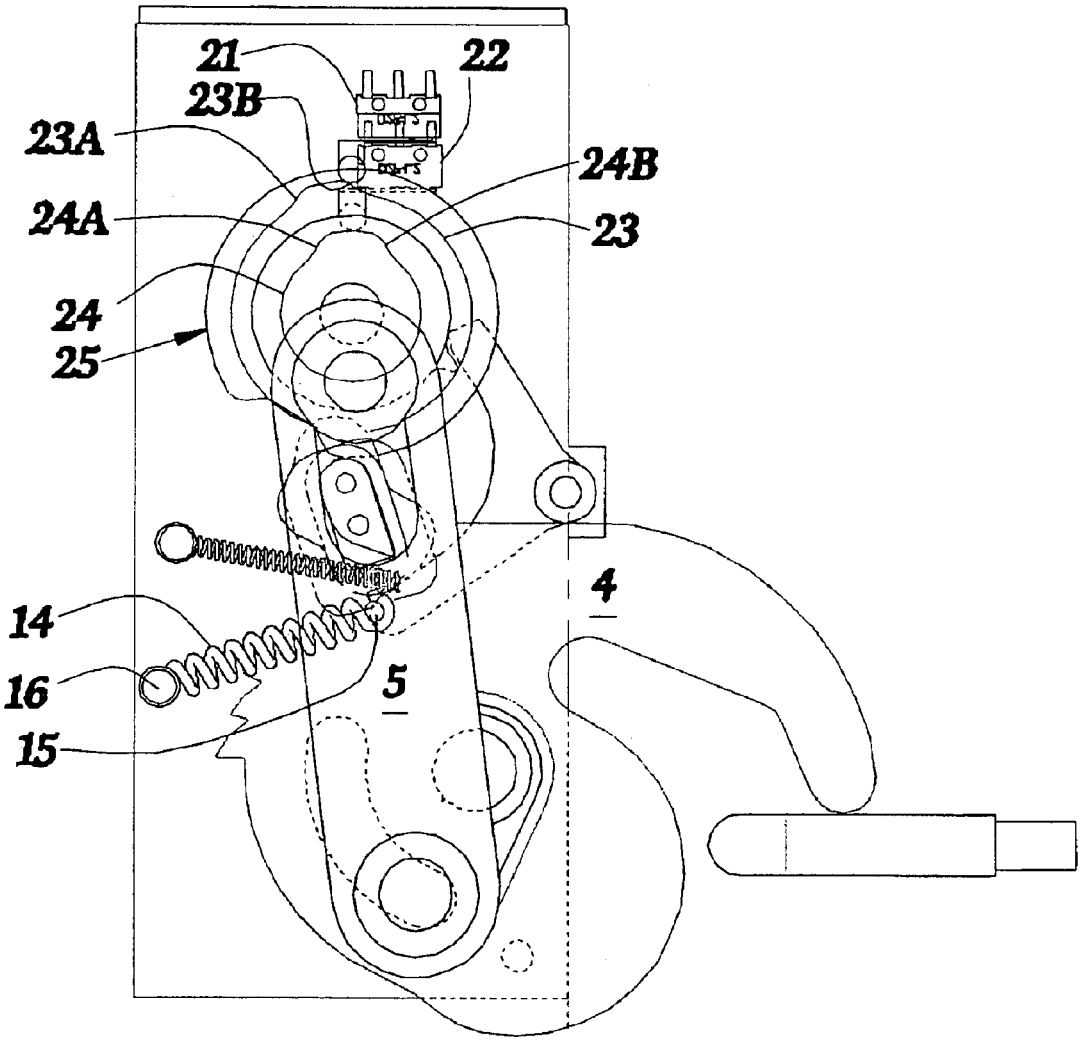
FIG. 3 is similar to FIG. 2 except the left mounting plate has been removed. The locking hook is completely open and the ratchet is engaged.

Turning now to FIG. 3, the left side view is again illustrated, this time with mounting plate 11 removed. This figure illustrates the inner workings of the feedback switches and the multifunction wheel. The multifunction wheel 25 is composed of feedback switch cam surfaces 23 and 24. Cam surfaces 23A,B are integral to cam surface 23, and cam surfaces 24A,B are integral to cam surface 24. As the wheel 25 rotates, it brings ascending cam surfaces 23A and 24A into contact with feedback switches 21 and 22 respectively. When this contact is made, the switches are electrically closed. As the wheel 25 continues to rotate, the risen sections of cam surfaces 23 and 24 keep feedback switches 21 and 22 closed until descending cam surfaces 23B and 24B release and therefore electrically open the feedback switches. The feedback switches 21 and 22 are provided with rollers to minimize wear.

As link 5 pulls on locking hook 4, causing it to rotate, spring 14 begins to stretch and charge (increasing its potential energy). Locking hook spring 14 is mounted on one end to mounting plate 11 with screw 16, and on the other end to locking hook 4 with screw 15. This spring is used with the release operation described in FIG. 6.

Figure 4:
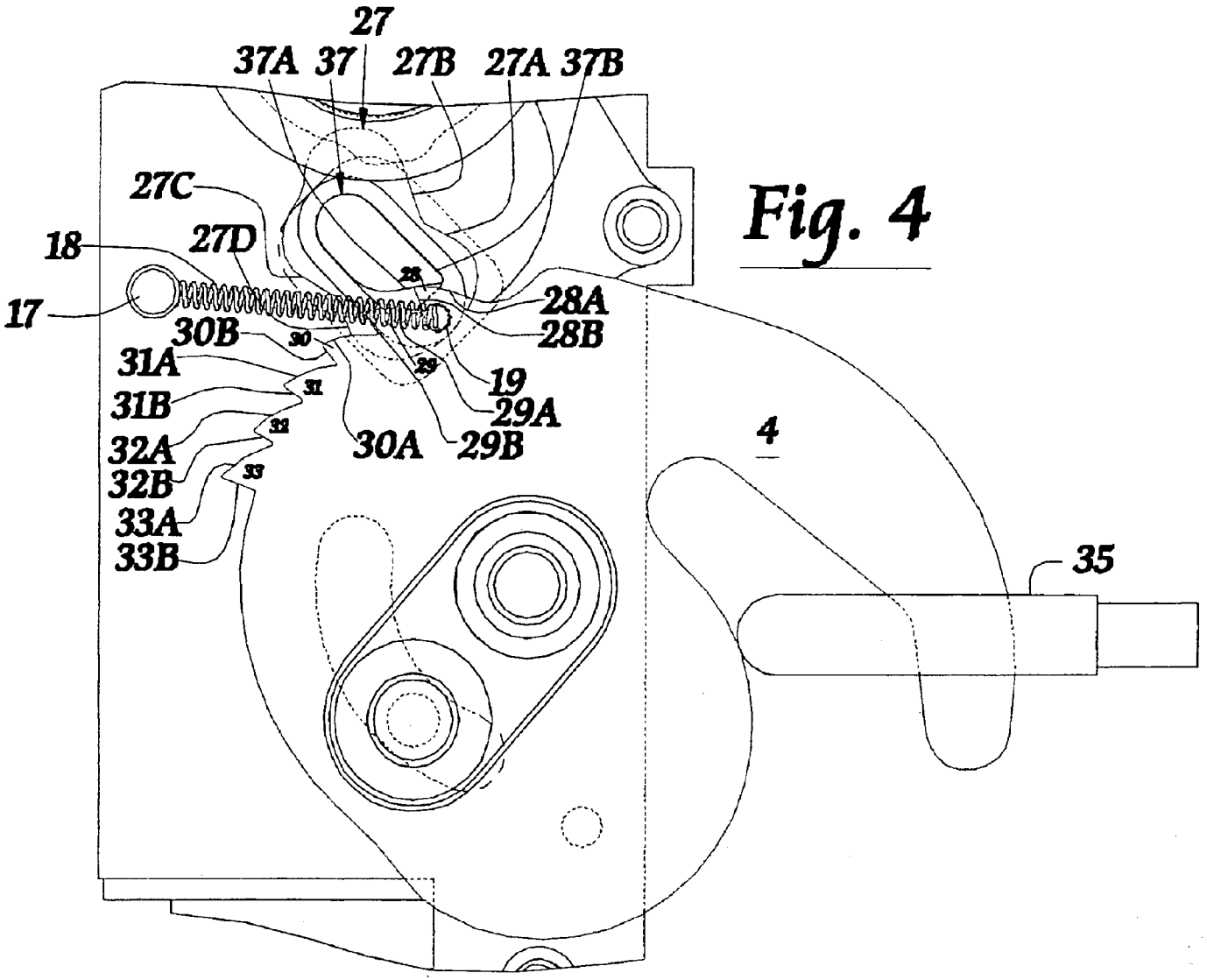
FIG. 4 is similar to FIG. 3 except the u-bolt is pushing the locking hook closed, moving the ratchet.

Turning now to FIG. 4 the ratchet action is illustrated. As locking hook 4 rotates, it is engaged by ratchet assembly 37 at teeth 28,29,30,31,32,33. These teeth are provided with a ratchet side 28A, 29A, 30A, 31A, 32A and 33A respectively and a locking side 28B, 29B, 30B, 31B, 32B, and 33B respectively. Ratchet assembly 37 is provided with a ratchet side 37A and a lock side 37B. The ratchet assembly 37, rotates within ratchet guide 27. Ratchet guide 27 is made up of two ratchet edges 27A and 27C and two lock edges 27B and 27D. Ratchet guide 27 is integral to both sides of mounting plate 11.

Illustrated in FIG. 4 is tooth 28 ratcheting the ratchet 37. The ratchet side of tooth 28, 28A, is contacting ratchet assembly 37 its the ratchet surface 37A. This causes ratchet 37 to rotate freely within the ratchet guide 27 inside openings created by edges 27A and 27C. Ratchet 37 is biased in the clockwise direction within ratchet guide 27 by ratchet spring 18. Ratchet spring 18 is mounted to mount plate 11 by screw assembly 17 and to the ratchet at screw assembly 19. When the ratchet surface 37A reaches the end of 28A it is pulled by ratchet spring 18 to the side of tooth 28's locking side 28B. This occurs due to the end of surface 28A and charged ratchet spring 18, pulling ratchet edge 37A into contact with tooth 29's ratchet edge 29A. This repeats until ratchet edge 37B is seated behind tooth 33B, as illustrated in FIG. 5.

Figure 5:
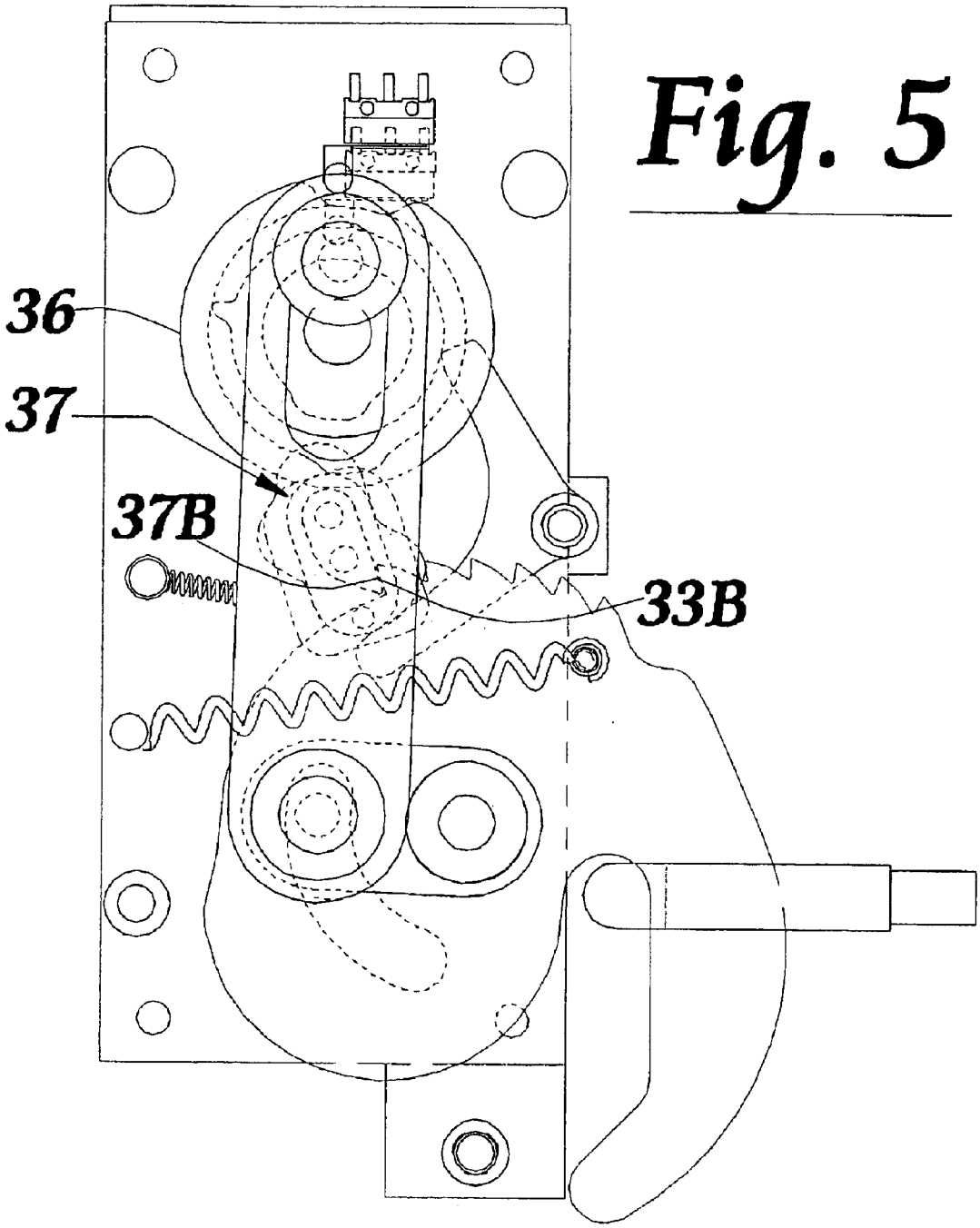
FIG. 5 is similar to FIG. 3 except the locking hook is fully closed and the ratchet is engaged into the last tooth of the locking hook.

Turning to FIG. 5 the fully locked state, described above, is illustrated. Once the locking hook's tooth surface 33B is engaged by ratchet surface 37B, it is not possible to open the locking hook, due primarily to the multifunction wheel 25 having surface 36 in contact with ratchet 37 (aside from the tooth engagement). This engagement also makes the assembly act like a deadbolt, that is, it is not able to open until the opening formed by cam profiles 36A and 36B in the multifunction wheel is in line with the ratchet.

Figure 6:
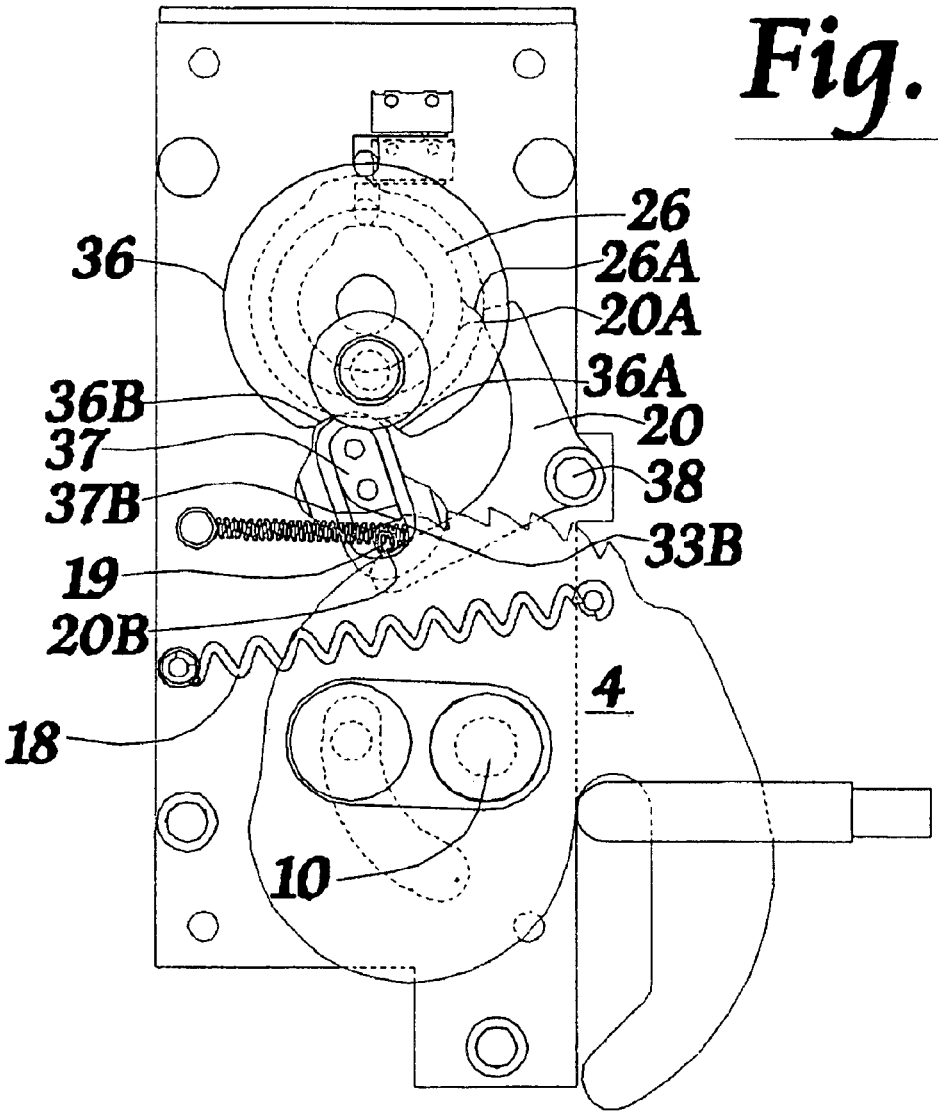
FIG. 6 is similar to FIG. 5 except the ratchet release lever is pushing the ratchet off of the last tooth.

Turning now to FIG. 6, the opening state is illustrated. As multifunction wheel 25 continues to rotate, an opening in cam surface 36 beginning with descending edge 36A and ending with ascending edge 36B allows the ratchet assembly's surface 37B to be pushed off of the last tooth surface 33B.

The multifunction wheel 25 is additionally provided with release lever cam surface 26 which incorporates ascending surface 26A. As wheel 25 rotates, it brings ascending ratchet release cam surface 26A into contact with ratchet release lever 20 at surface 20A. When ratchet release cam surface 26A hits ratchet release lever 20 it causes it to rotate clockwise about screw and bushing assembly 38. As the release lever 20 rotates, integral surface 20B pushes on ratchet assembly 37 at ratchet spring holder 19 causing it to move in the upward direction. It is now able to move in this direction because cam surface 36 is now past the descending surface 36A which allows the ratchet assembly to move up. The ratchet assembly 37 moves up until the end of its ratchet surface 37B is clear of the last locking tooth 33B on the locking hook 4. Now, the locking hook is released and it is able to rotate freely about locking hook fulcrum 10, and charged spring 18 pulls it in the counterclockwise direction until the latch hook is fully open.

Figure 7:
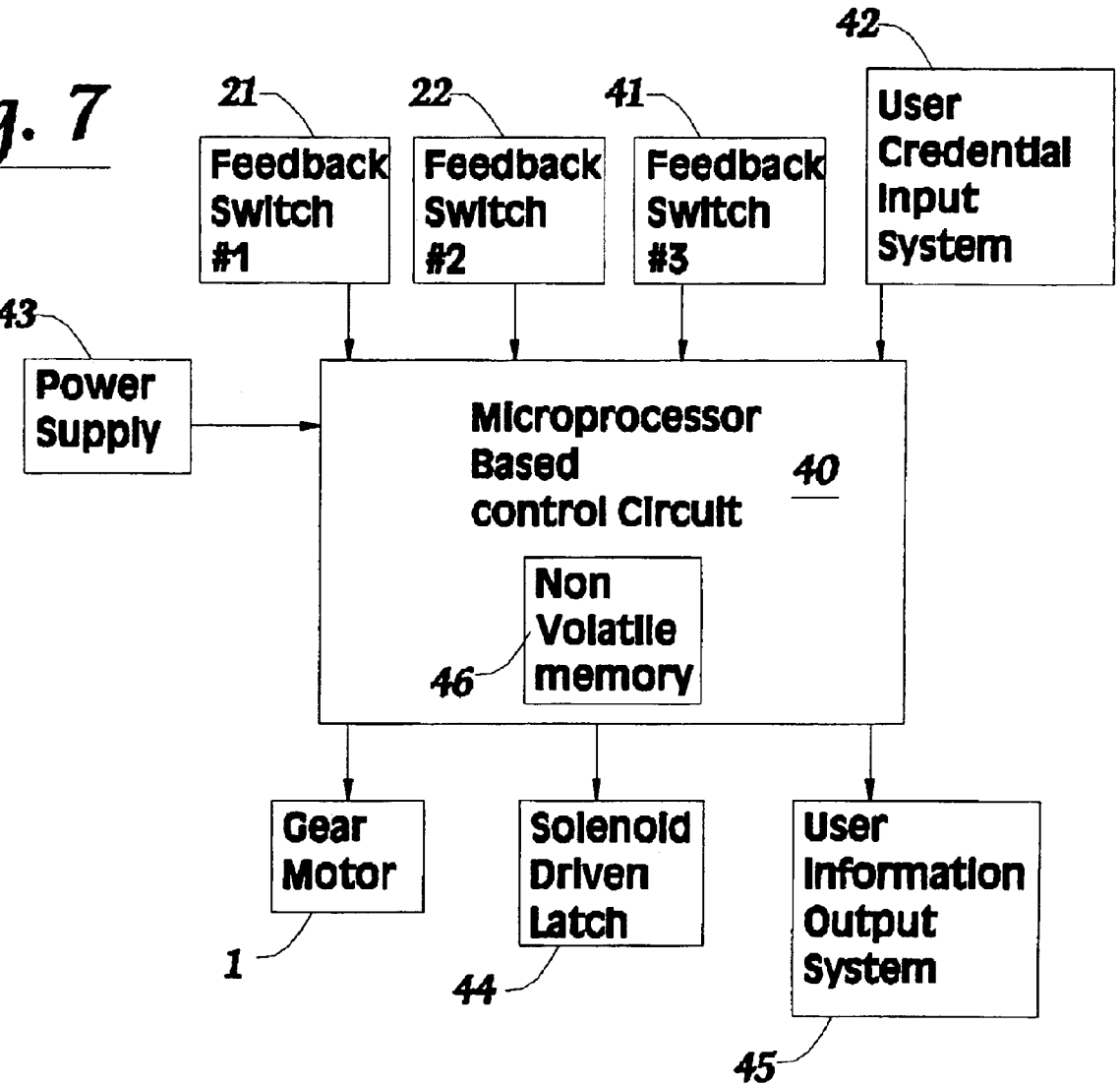
FIG. 7 is a functional block diagram of the control system.

FIG. 7 illustrates the block diagram of the electrical system. The power supply 43 can be any conventional supply, for this embodiment it is a 120VAC/24VDC 2 amp supply. The supply 43 powers the microprocessor based control circuit 40. The control circuit 40 reads the feedback switches 21,22,41 and the user credential input system 42. The credential system can be any type of electronic access control credential including RF, IR, Magstripe cards, Smart cards, etc. but for this embodiment it is a Dallas semiconductor I-Button. These keys are provided with internal memory, capable of remembering each vending machine's encrypted password as well as an encrypted key number. As described earlier, the machine's password changes each time the key is used.

When the microprocessor based control circuit 40 reads an I-button through the user credential input system 42 it first decrypts the serial number of the key. The control circuit then checks the non-volatile memory to see if that key has access to the lock. If that key is in memory, it then reads and decrypts the password from the key. If the password matches the password stored in non volatile memory, corresponding to the key number, then the key is deemed valid.

A new password is generated, encrypted and stored in the key and in nonvolatile memory in the control board.

At this point, the optional solenoid driven latch 44 is opened. This latch is used in a different area of the door as the present invention to provide a more secure lock. The solenoid plunger is a simple bolt mounted inside a solenoid that engages a hole in the main chamber of the vending machine. The gear motor 3 is then energized to open the lock. Complete electrical details on a lock open and close cycle are described below under FIG. 8. Finally, the vending machine access is stored in nonvolatile memory. The entire history of accesses can be accessed through the user information output system 45. This output system could employ another Dallas semiconductor I-button, a laptop computer, a palm pilot etc. This system has the ability to read the prior accesses along with the date and time.

Figure 8:
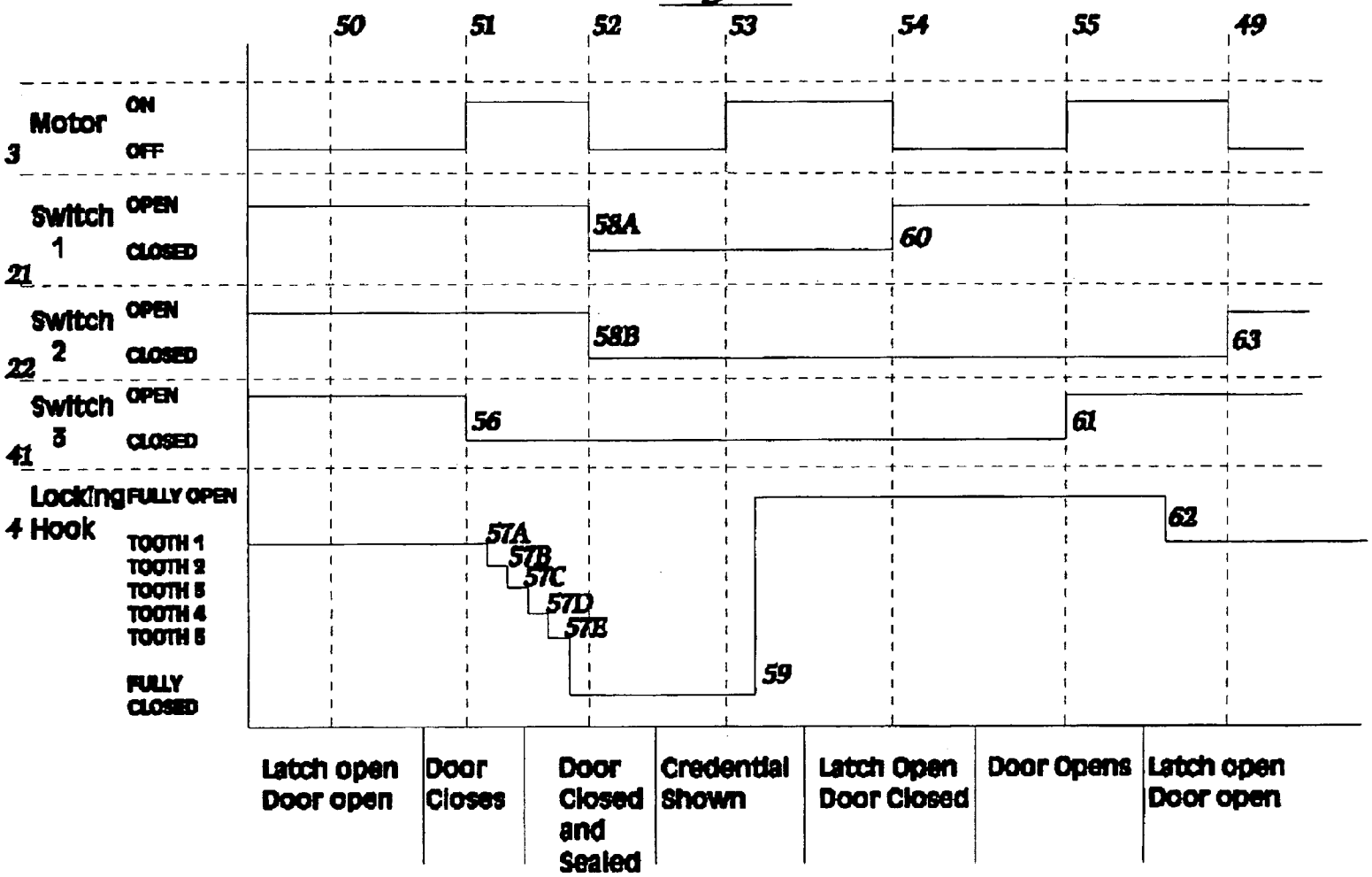
FIG. 8 is a timing diagram, illustrating the various operating modes of the system.

Turning now to the timing diagram in FIG. 8. This diagram illustrates the states of the feedback switches 21,22, 41 and the locking hook 4 with respect to the state of the system electronics and the vending machine.

Again, for purposes of this illustration, the starting point will be with the latch and the door open, with the routeman filling the machine, time event 50. In this state, motor 3 is off, feedback switches 1,2, and 3 (21,22,41) are open and the locking hook 4 has the ratchet 37 on tooth 1 (28). In this state the microprocessor is waiting for the vending machine door to be closed, which will close switch 3 (41). This event occurs at time 51 at event 56. When the switch closes, the control circuit turns on the motor 3, to advance the multifunction wheel 25 which moves link 5, which rotates locking hook 4 as fully described above. The motor continues to run until the locking hook advances past teeth 2,3,4,5, and 6 (28,29,30,31,32,33) (events 57A,B,C,D,E) and switches 1 (21) and 2 (22) close, events 58A, 58B, time 52. In this state, the vending machine door is fully closed, the door is sealed shut, and the microprocessor is waiting for a user credential to be shown and validated, which occurs at time 53. After the microprocessor validates the credential, the control circuit 40 again turns on the motor 3. Very soon after the motor is turned on, the ratchet 37 is pulled off the locking hook 4 and the locking hook 4 is released at event 59. The motor 3 remains energized until switch 1 (21) opens, event 60, time 54. In this state, the microprocessor is waiting for the vending machine door to be pulled open. The locking hook 4 is completely free, as the ratchet 37 is pulled completely out of the way of all of the hook's teeth (28,29,30,31,21,33). When the door is pulled open, switch 3 (41) is opened, event 61, time 55. At this time, the control circuit 40 turns on the motor 3 which causes surface 36B to push the ratchet back down onto tooth 1 (28), event 62. The motor 3 stays on until switch 2 (22) opens, event 63, time 49. This sequence then repeats itself.

Figure 9:
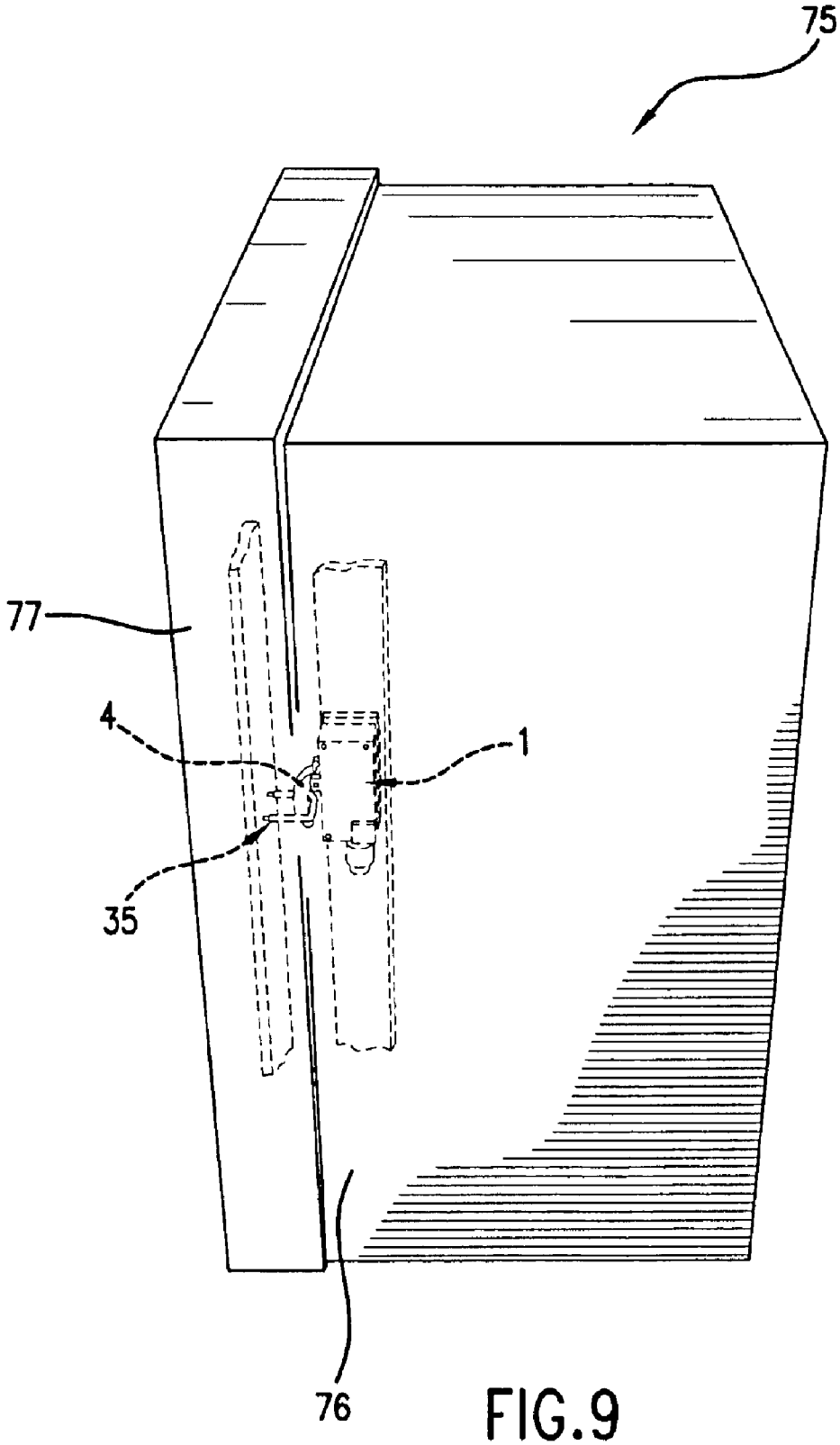
FIG. 9 is a perspective view of a compartment that is a vending machine in which the locking hook is connected to the frame and the compartment member is connected to the door.
Figure 10:
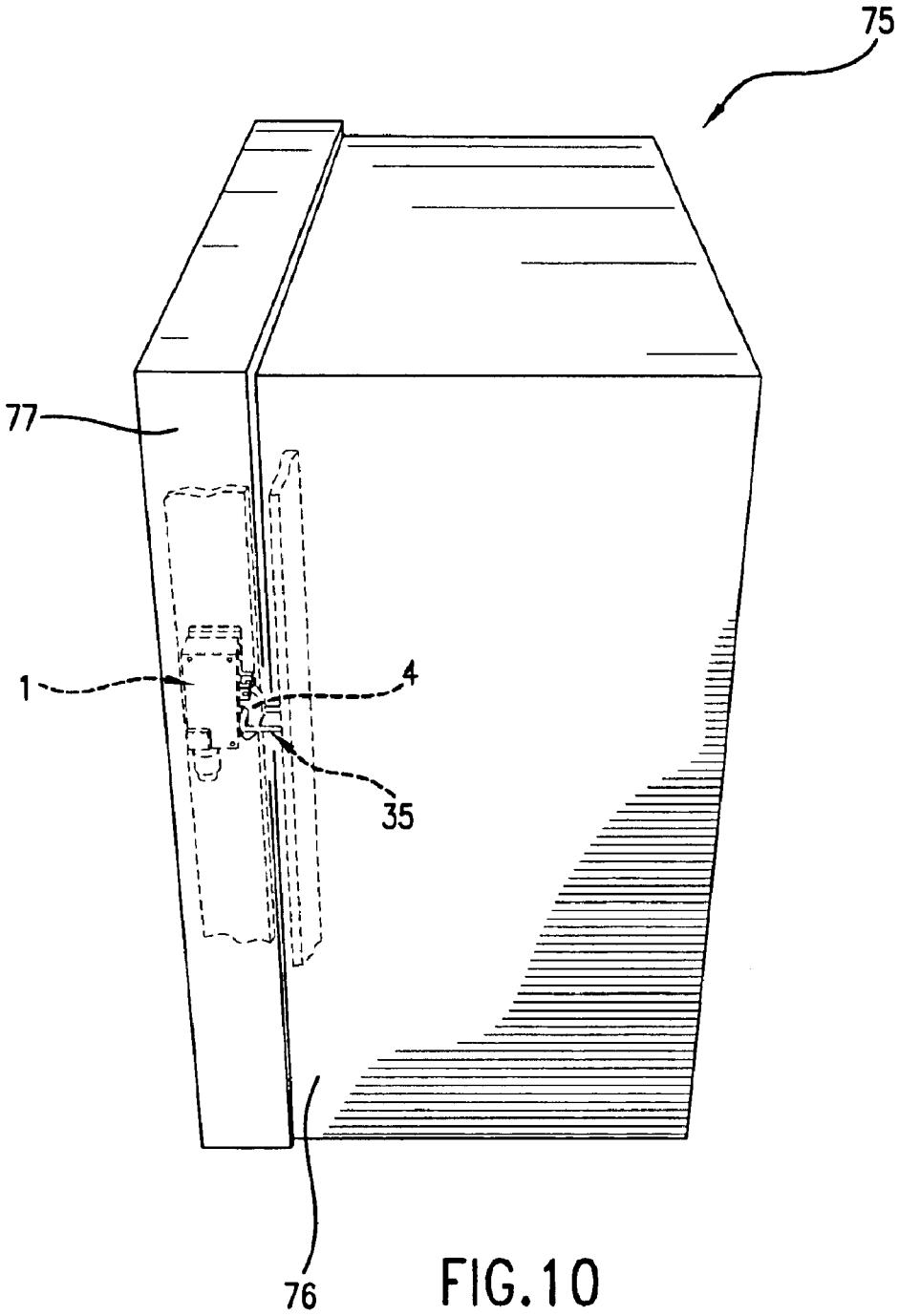
FIG. 10 is a perspective view of a compartment that is a vending machine in which the locking hook is connected to the door and the compartment member is connected to the frame.

FIGS. 9 and 10 show an exemplary embodiment of the electromechanical locking mechanism. In FIG. 9, the compartment 75 is a vending machine into which the electromechanical locking mechanism may be incorporated. The compartment 75 includes a frame 76 and a door 77 that is hingedly attached to the frame 76. The locking hook 4 is attached to the frame 76 and pivots in relation thereto. The compartment member 35 is attached to the door 77. FIG. 10 is an alternative arrangement of the electromechanical locking mechanism in which the locking hook 4 is pivotally connected to the door 77 and the compartment member 35 is connected to the frame 76.

What is claimed:

1. A locking assembly, comprising:

a compartment having a door and a frame;

a locking hook carried by said compartment and pivotal with respect to said compartment, said locking hook pivotal from an unlocked position to a locked position;

a motor in communication with said locking hook, said motor capable of causing said locking hook to be pivoted to said locked position and to said unlocked position based upon operation in the same direction;

a compartment member carried by said compartment, said locking hook engaging said compartment member and drawing said door of said compartment into a locked position when said locking hook is pivoted into a locked position, said motor pivoting said locking hook to automatically draw in said locking hook to said locked position, wherein the locking hook is connected to one of the door or the frame, and wherein the compartment member is connected to the other one of the door or the frame that is not connected to the locking hook; and a link slideably engaging said locking hook such that said link is capable of pivoting said locking hook with respect to said compartment.

2. The locking assembly of claim 1, wherein said compartment member is connected to said door of said compartment.

3. The locking assembly of claim 1, wherein said locking hook and said motor are connected to said door of said compartment.

4. The locking assembly of claim 1, wherein said locked position of said door of said compartment is a sealed position.

5. The locking assembly of claim 1, wherein said compartment is a vending machine and wherein said compartment member is a U-bolt.

6. The locking assembly of claim 1, further comprising a locking hook spring carried by said compartment and said locking hook, said locking hook spring biasing said locking hook towards said unlocked position.

7. The locking assembly of claim 1, wherein said locking hook is capable of being pivoted from said unlocked position to said locked position without the use of said motor by manual force applied on said locking hook causing said locking hook to rotate, and said locking assembly further comprises a ratchet assembly engaging said locking hook during application of manual force and locking said locking hook into said locked position after application of manual force.

8. The locking assembly of claim 1, further comprising a pair of solenoid driven latches carried by said compartment and configured to lock said door such that said locking assembly is capable of being a three point lock.

9. A locking assembly, comprising:

a compartment having a door and a frame;

a locking hook carried by said compartment and pivotal with respect to said compartment, said locking hook pivotal from an unlocked position to a locked position;

a motor in communication with said locking hook, said motor capable of causing said locking hook to be pivoted to said locked position and to said unlocked position based upon operation in the same direction;

a compartment member carried by said compartment, said locking hook engaging said compartment member and drawing said door of said compartment into a locked position when said locking hook is pivoted into a locked position, said motor pivoting said locking hook to automatically draw in said locking hook to said locked position, wherein the locking hook is connected to one of the door or the frame, and wherein the compartment member is connected to the other one of the door or the frame that is not connected to the locking hook;

a link slideably engaging said locking hook such that said link being capable of pivoting said locking hook with respect to said compartment; and a multifunction wheel carried by said compartment and rotatable with respect to said compartment, said multifunction wheel engaging said link, said motor being in communication with said multifunction wheel in order to rotate said multifunction wheel to cause said link to move to cause said locking hook to pivot.

10. The locking assembly of claim 9, wherein said multifunction wheel has a plurality of cam surfaces located thereon, and wherein said locking hook has a plurality of teeth located thereon; and said locking assembly further comprises a ratchet assembly engageable with said multifunction wheel, said ratchet assembly engaging at least one tooth of said locking hook when said locking hook is in said locked position, said ratchet assembly engageable with a first of said cam surfaces of said multifunction wheel to allow said ratchet assembly to be urged out of engagement with said at least one tooth of said locking hook, said first cam surface also engageable with said ratchet assembly in order to hold said ratchet assembly in said locked position.

11. The locking assembly of claim 10, further comprising a ratchet spring attached to said ratchet assembly and carried by said compartment, said ratchet spring biasing said ratchet assembly to move across said plurality of teeth of said locking hook.

12. The locking assembly of claim 10, further comprising a ratchet release lever carried by said compartment and pivotal with respect to said compartment, said ratchet release lever engageable with a second one of said cam surfaces of said multifunction wheel and being pivoted during engagement with said second cam surface so as to urge said ratchet assembly out of engagement with said at least one tooth of said locking hook.

13. The locking assembly of claim 9, wherein said multifunction wheel has a plurality of cam surfaces located thereon, and said locking assembly further comprises a microprocessor in communication with said motor in order to turn on and off said motor; a first sensor in communication with said microprocessor and with one of said cam surfaces of said multifunction wheel, said first sensor providing a signal used to cause said motor to turn off; a second sensor in communication with said microprocessor and with one of said cam surfaces of said multifunction wheel, said second sensor providing a signal used to cause said motor to turn off; and a third sensor in communication with said microprocessor, said third sensor providing a signal used to cause said motor to turn on.

14. A locking mechanism, comprising:

a mounting plate;

a locking hook carried by said mounting plate and pivotal with respect to said mounting plate, said locking hook pivotal from an unlocked position to a locked position;

a motor in communication with said locking hook, said motor capable of causing said locking hook to be pivoted to said locked position and to said unlocked position based upon operation in the same direction; and a link slideably engaging said looking hook such that said link is capable of pivoting said locking hook with respect to said mounting plate.

15. The locking mechanism of claim 14, wherein said mounting plate is attached to a compartment having a door, and further comprising a compartment member, said locking hook engaging said compartment member and drawing said compartment member and said door into a locked position when said locking hook is pivoted into a locked position, said motor rotating said locking hook in order to automatically draw in said locking hook to said locked position.

16. The locking mechanism of claim 15, wherein said compartment is a vending machine and wherein said compartment member is a U-bolt.

17. The locking mechanism of claim 14, further comprising a locking hook spring attached to said mounting plate and said locking hook, said locking hook spring biasing said locking hook towards said unlocked position.

18. The locking mechanism of claim 14, wherein said locking hook is capable of being pivoted from said unlocked position to said locked position without the use of said motor by manual force applied on said locking hook causing said locking hook to rotate, and said locking mechanism further comprises a ratchet assembly engaging said locking hook during application of manual force and locking said locking hook into said locked position after application of manual force.

19. The locking mechanism of claim 15, wherein said locked position of said door is a sealed position.

20. A The locking mechanism of claim 14, further comprising a pair of solenoid driven latches carried by said mounting plate and configured to be actuated into a locked position such that said locking mechanism is capable of being a three point lock.

21. A locking mechanism, comprising:

a mounting plate;

a locking hook carried by said mounting plate and pivotal with respect to said mounting plate, said locking hook pivotal from an unlocked position to a locked position;

a motor in communication with said locking hook, said motor capable of causing said locking hook to be pivoted to said locked position and to said unlocked position based upon operation in the same direction;

a link slideably engaging said locking hook such that said link being capable of pivoting said locking hook with respect to said mounting plate; and a multifunction wheel carried by said mounting plate and rotatable with respect to said mounting plate, said multifunction wheel engaging said link, said motor being in communication with said multifunction wheel in order to rotate said multifunction wheel to cause said link to move to cause said locking hook to pivot.

22. The locking mechanism of claim 21, wherein said multifunction wheel has a plurality of cam surfaces located thereon, and wherein said locking hook has a plurality of teeth located thereon; and said locking mechanism further comprises a ratchet assembly engageable with said multifunction wheel, said ratchet assembly engaging at least one tooth of said locking hook when said locking hook is in said locked position, said ratchet assembly engageable with a first of said cam surfaces of said multifunction wheel to allow said ratchet assembly to be urged out of engagement with said at least one tooth of said locking hook, said first cam surface also engageable with said ratchet assembly in order to hold said ratchet assembly in said locked position.

23. The locking mechanism of claim 22, further comprising a ratchet spring attached to said ratchet assembly and said mounting plate, said ratchet spring biasing said ratchet assembly to move across said plurality of teeth of said locking hook.

24. The locking mechanism of claim 22, further comprising a ratchet release lever carried by said mounting plate and pivotal with respect to said mounting plate, said ratchet release lever engageable with a second one of said cam surfaces of said multifunction wheel and being pivoted during engagement with said second cam surface so as to urge said ratchet assembly out of engagement with said at least one tooth of said locking hook.

25. The locking mechanism of claim 21, wherein said multifunction wheel has a plurality of cam surfaces located thereon, and said locking mechanism further comprises a microprocessor in communication with said motor in order to turn on and turn off said motor; a first sensor in communication with said microprocessor and with one of said cam surfaces of said multifunction wheel, said first sensor providing a signal used to cause said motor to turn off; a second sensor in communication with said microprocessor and with one of said cam surfaces of said multifunction wheel, said second sensor providing a signal used to cause said motor to turn off; and a third sensor in communication with said microprocessor, said third sensor providing a signal used to cause said motor to turn on.

26. A locking mechanism, comprising:

a mounting plate;

a locking hook pivotally carried by said mounting plate, said locking hook having a plurality of teeth located thereon, said locking hook pivotal from an unlocked position to a locked position;

a link slideably engaging said locking hook such that said link being capable of pivoting said locking hook with respect to said mounting plate;

a multifunction wheel carried by said mounting plate and rotatable with respect to said mounting plate, said multifunction wheel having a plurality of cam surfaces located thereon, said link engaging said multifunction wheel;

a ratchet assembly engageable with said multifunction wheel, said ratchet assembly engaging at least one tooth of said locking hook when said locking hook is in said locked position, said ratchet assembly engageable with a first of said cam surfaces of said multifunction wheel to allow said ratchet assembly to be urged out of engagement with said at least one tooth of said locking hook;

a ratchet release lever carried by said mounting plate and pivotal with respect to said mounting plate, said ratchet release lever engageable with a second one of said cam surfaces of said multifunction wheel and being pivoted during engagement with said second cam surface so as to urge said ratchet assembly out of engagement with said at least one tooth of said locking hook;

a locking hook spring attached to said mounting plate and said locking hook, said locking hook spring biasing said locking hook towards said unlocked position;

a ratchet spring attached to said ratchet assembly and said mounting plate, said ratchet spring biasing said ratchet assembly to move across said plurality of teeth of said locking hook; and a motor in communication with said multifunction wheel in order to cause rotation of said multifunction wheel, wherein said multifunction wheel is rotatable in a single direction such that said motor is capable of rotating said multifunction wheel in order to move said link and cause said locking hook to pivot to said locked position and said motor is capable of rotating said multifunction wheel in order to engage said ratchet assembly with said first cam surface of said multifunction wheel and in order to engage said ratchet release lever with said second cam surface of said multifunction wheel to allow said locking hook to pivot to said unlocked position.

* * * * *

UNITED STATES PATENT AND TRADEMARK OFFICE

CERTIFICATE OF CORRECTION

PATENT NO. : 6,886,869 B2
DATED : May 3, 2005
INVENTOR(S) : Richard A. Martinez et al.

It is certified that error appears in the above-identified patent and that said Letters Patent is hereby corrected as shown below:

Column 8,
Line 45, "looking" should read -- locking --.

Signed and Sealed this

Sixteenth Day of August, 2005

JON W. DUDAS
*Director of the United States Patent and Trademark Office*